US005738272A

United States Patent [19]

Anchor et al.

[11] Patent Number: 5,738,272

[45] Date of Patent: Apr. 14, 1998

[54] GABLE TOP CARTON AND CARTON BLANK HAVING REDUCED SURFACE AREA PER UNIT VOLUME

[75] Inventors: David Anchor, Itasca, Ill.; Tommy Bo Göran Ljungström, Höör, Sweden

[73] Assignee: Tetra Laval Holdings & Finance S.A., Pully, Switzerland

[21] Appl. No.: 620,698

[22] Filed: Mar. 21, 1996

[51] Int. Cl.[6] ..... B65D 5/02

[52] U.S. Cl. ..... 229/109; 229/116.1; 229/920; D9/432

[58] Field of Search ..... 229/109, 116.1, 229/137, 138, 920; D9/430, 432, 433

[56] References Cited

U.S. PATENT DOCUMENTS

| | | | |
|---|---|---|---|
| D. 244,993 | 7/1977 | Drysdale | D9/432 |
| 2,050,894 | 8/1936 | Paige | 229/116.1 |
| 3,126,143 | 3/1964 | Hagan | 229/920 |
| 3,610,514 | 10/1971 | Samsing | 229/116.1 |
| 4,714,164 | 12/1987 | Bachner | 229/920 |

FOREIGN PATENT DOCUMENTS

| | | | |
|---|---|---|---|
| 276893 | 8/1988 | European Pat. Off. | 229/138 |
| 277673 | 8/1988 | European Pat. Off. | 229/138 |

*Primary Examiner*—Gary E. Elkins

*Attorney, Agent, or Firm*—McAndrews, Held & Malloy Ltd.; Michael A. Catania

[57] ABSTRACT

A blank for forming a gable top carton is set forth which reduces the surface area of the carton for a given carton volume. The carton blank comprises a generally rectangular body having an upper section, a mid section, and a lower section, each of the sections being separated from each other by one or more generally horizontal score lines. The upper section of the rectangular body comprises a plurality of score lines for defining a gabled top of the resulting carton while the lower section of the rectangular body comprises a plurality of score lines for defining a folded bottom section of the resulting carton. The mid section of the rectangular body comprises a plurality of score lines for defining four sidewalls of the resulting carton. Adjacent sidewalls are separated from one another by a first score line partially extending from the upper section and a second score line partially extending from the lower section. The endpoints of the first and second score lines are separated from one another to thereby allow the resulting carton to bulge.

19 Claims, 11 Drawing Sheets

Fig. 1
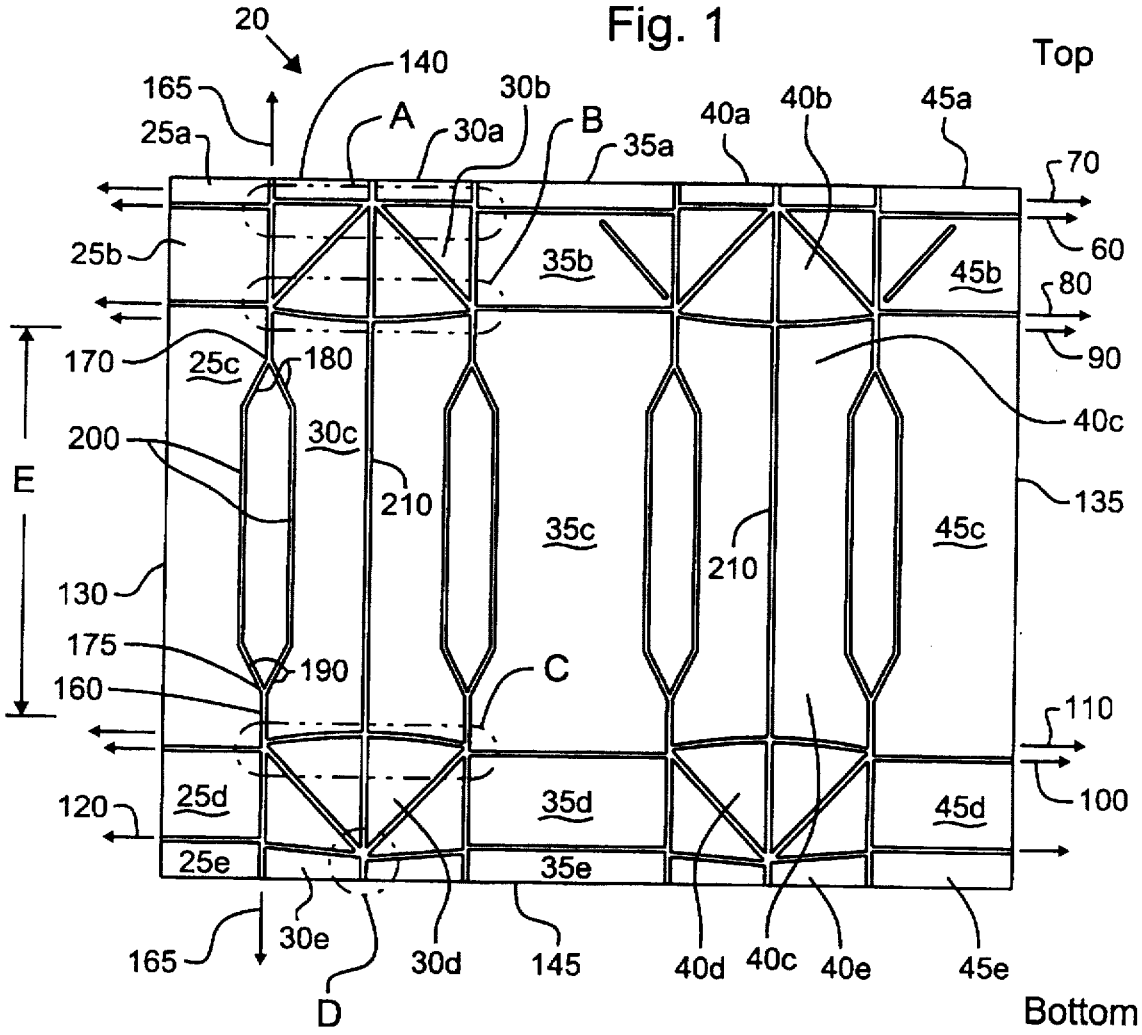
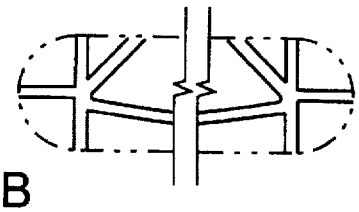
Fig. 1B
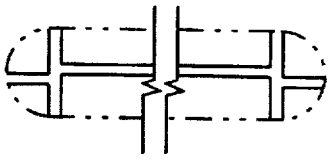
Fig. 1A
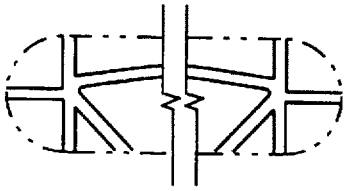
Fig. 1C
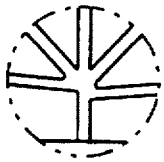
Fig. 1D Fig. 8
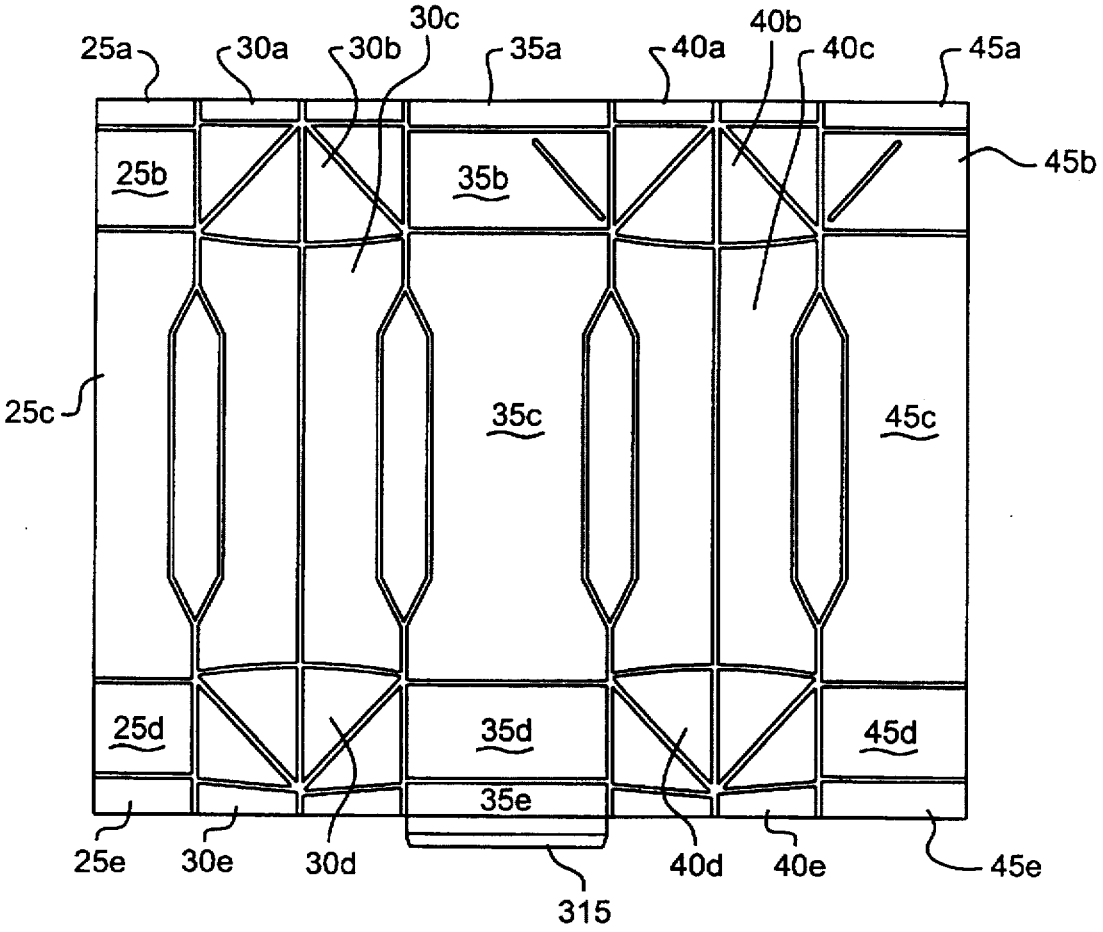
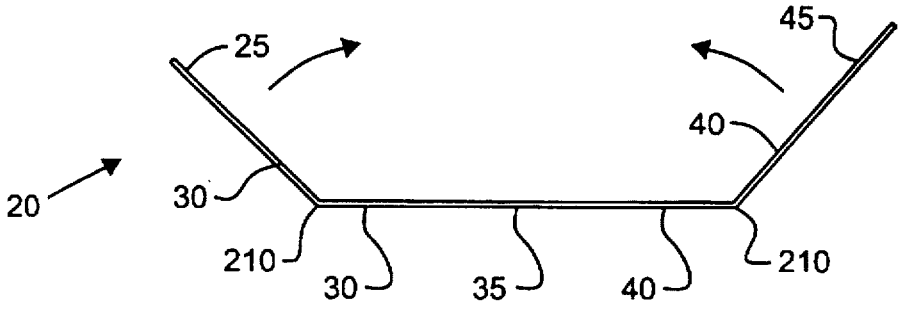
Fig. 2A
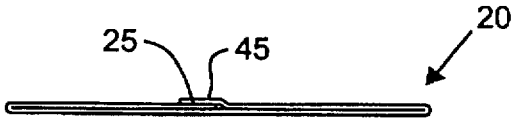
Fig. 2B

GABLE TOP CARTON AND CARTON BLANK HAVING REDUCED SURFACE AREA PER UNIT VOLUME

TECHNICAL FIELD

The present invention relates to a gable top carton and corresponding carton blank. More specifically, the present invention relates to a gable top carton and carton blank having a reduced surface area per unit volume of the carton when compared to conventional gable top carton configurations.

BACKGROUND

Gable top cartons have been known for the better part of the twentieth century. Their characteristic simplicity and resealability have helped to sustain their popularity as containers for traditional liquid food products such as milk and juice, but in recent years they have been used for products ranging from ammunition to Epsom salts. Gable top cartons typically start out as generally rectangular carton blanks made of laminated paperboard or similar material. The carton blanks are provided with a number of creases to facilitate folding and forming the blank into a rectangular carton having the characteristic gabled top.

When fully folded, filled, and sealed, the gable top cartons include; a gabled top structure (whether folded flat or remaining erect) that engages a plurality of side panels. Traditionally, each side panel is generally perpendicular to each adjacent side panel. The panels are each divided from one another by a single vertical score line extending the entire height of the sidewall. These side panels form the characteristic hollow rectangular body of the container and define the volume of product that a carton can hold.

In accordance with accepted design approaches, the design of a traditional gable top carton to accommodate a specified volume involves adjusting the dimensions of the four sidewalls defining the rectangular body that is to contain the specified volume. Very often, these product volume requirements are specified by the packager and selected from standard volumes that have been deemed accepted in the consumer market for the product (i.e., pint, quart, half gallon, gallon, ½ liter, liter, etc.). When this design approach is utilized, there exists a generally established relationship between the surface area of the carton blank and the carton volume. The surface area of the carton, and particularly the area of the four sidewalls constituting the bulk of the surface area, is thus generally fixed for a given container volume.

Additional end panel extensions and end panel shapes are often employed to assist in folding and sealing the traditional gable top cartons. These added extensions and shapes result in added carton surface area per unit volume of product.

The traditional approaches to gable top carton design have heretofore devoted little effort to optimizing the carton surface area per unit volume of product.

SUMMARY OF THE INVENTION

A blank for forming a gable top carton is set forth which reduces the surface area of the carton for a given carton volume. The carton blank comprises a generally rectangular body having an upper section, a mid section, and a lower section, each of the sections being separated from each other by one or more generally horizontal score lines. The upper section of the rectangular body comprises a plurality of score lines for defining a gabled top of the resulting carton while the lower section of the rectangular body comprises a plurality of score lines for defining a folded bottom section of the resulting carton. The mid section of the rectangular body comprises a plurality of score lines for defining four sidewalls of the resulting carton. Adjacent sidewalls are separated from one another by a first score line partially extending from the upper section and a second score line partially extending from the lower section. The endpoints of the first and second score lines are separated from one another to thereby allow the resulting carton to bulge.

In accordance with one advantageous embodiment of the carton blank, the first and second score lines are generally collinear and the blank further comprises a plurality of further score lines between the first and second score lines of the corner sections. The plurality of further score lines are offset from the first and second score lines and, for example, may define an elongated hexagonal structure that joins the end points of the first and second score lines.

A carton formed from such a blank is also disclosed.

Other objects and advantages of the present invention will become apparent upon reference to the accompanying detailed description when taken in conjunction with the following drawings.

BRIEF DESCRIPTION OF THE DRAWINGS

FIGS. 1, 1A, 1B, 1C, and 1D are plan views of a blank constructed in accordance with one embodiment of the present invention.

FIGS. 2A and 2B illustrate the folding of the blank of FIG. 1 for side sealing and subsequent supply to a packaging machine.

FIG. 8 illustrates a still further modification to the bottom configuration of the blank of FIG. 1.

DETAILED DESCRIPTION OF THE PREFERRED EMBODIMENTS

Figure 3:
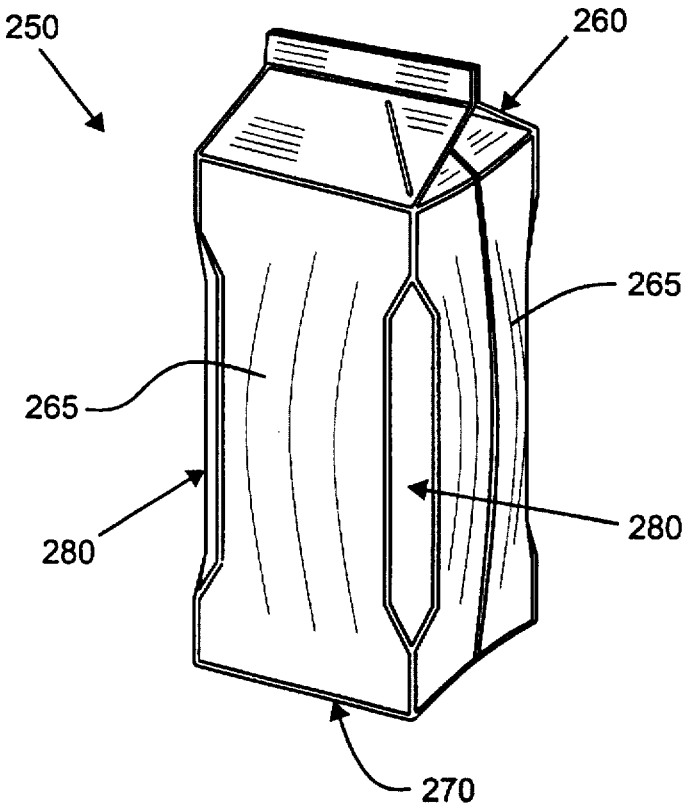
FIGS. 3 and 4 are perspective side elevational views of a carton constructed from the blank FIG. 1.

FIG. 1 illustrates one embodiment of a blank that may be used to form a carton in accordance with the teachings of the present invention. The carton blank 20 has a plurality of panels that are effectively separated from one another by a plurality of score lines. As viewed along the horizontal direction, the plurality of panels include first vertical panel sections 25*a–e*, second vertical panel sections 30*a–e*, third vertical panel sections 35*a–e*, fourth vertical panel sections 40*a–e*, and fifth vertical panel sections 45*a–e*. The first panel sections 25*a–e* have a smaller width than the fifth panel sections 45*a–e*, while both the first and fifth panel sections 25*a–e*, 45*a–e* are less wide than the second, third and fourth panel sections 30*a–e*, 35*a–e*, and 40*a–e*. As viewed along the vertical direction, the plurality of panels include top fin panels 25*a*, 30*a*, 35*a*, 40*a*, and 45*a*, top flaps 25*b*, 30*b*, 35*b*, 40*b*, and 45*b*, side panels 25*c*, 30*c*, 35*c*, 40*c*, and 45*c*, bottom flaps 25*d*, 30*d*, 35*d*, 40*d*, and 45*d*, and bottom fin panels 25*e*, 30*e*, 35*e*, 40*e*, and 45*e*.

As will become apparent from the descriptions of the various embodiments of the blanks of the present invention, the top fin panels 25*a*–45*a* and the top flaps 25*b*–45*b* fold to form the familiar gable top of the carton. As will be further evident, the score lines forming these top panels and flaps may take on a wide range of configurations. Similarly, the bottom flaps 25*d*–45*d* and bottom fin panels 25*e*–45*e* form the bottom of the carton and may take on any number of the configurations described herein.

In accordance with the embodiment illustrated in FIG. 1, the top of the blank and the bottom of the blank are defined by straight cuts. As a result, top fin panels 25*a*–45*a* each have a straight upper portion. A plurality of horizontally disposed score lines divide the top fin panels 25*a*–45*a* from the top flaps 25*b*–45*b*. The score lines dividing the top fin panels 25*a*, 35*a*, and 45*a* from top flaps 25*b*, 35*b*, and 45*b* lie generally along a first horizontal axis 60, while score lines dividing the top fin panels 30*a* and 40*a* from top flap 30*b* and 40*b* lie generally along a second horizontal axis 70 that is displaced from the first horizontal axis. Top flaps 30*b* and 40*b* each include a pair of diagonal score lines that converge at a respective apex. Each respective apex, for example, may converge at the horizontal score line dividing the respective top fin panel 30*a* and 40*a* and top flap 30*b* and 40*b*.

A second plurality of horizontally disposed score lines divide the top flaps 25*b*–45*b* from side panels 25*c*–45*c*. The score lines dividing the top flaps 25*b*, 35*b*, and 45*b* from side panels 25*c*, 35*c*, and 45*c* lie generally along the same third horizontal axis 80, while score lines dividing the top flaps 30*b* and 40*b* from side panels 30*c* and 40*c* lie generally along a fourth horizontal axis 90 that is displaced from the third horizontal axis. The score lines dividing the top flaps 30*b* and 40*b* from the side panels 30*c* and 40*c* are preferably curved score lines. The use of such curved score lines is disclosed in our U.S. Pat. No. 5,474,232, issued Dec. 12, 1995, hereby incorporated by reference. Such curved score lines allow the carton to be designed with a low profile gable top without a corresponding reduction in its functionality (i.e., without a reduction in the ability to open the carton). By employing a low profile gable top, the vertical dimensions of the top flaps 25*b*–45*b* may be reduced to thereby reduce the surface area of the carton.

A third plurality of horizontally disposed score lines divide the side panels 25*c*–45*c* from the bottom flaps 25*d*–45*d*. The score lines dividing the side panels 25*c*, 35*c*, and 45*c* from the bottom flaps 25*d*, 35*d*, and 45*d* lie generally along the same fifth horizontal axis 100, while score lines dividing the side panels 30*c* and 40*c* from bottom flaps 30*d* and 40*d* lie generally along a sixth horizontal axis 110 that is displaced from the fifth horizontal axis 100. The score lines dividing side panels 30cand 40*c* from bottom flaps 30*d* and 40*d* are curved score lines. The use of such curved score lines allows the carton to be designed with a gabled bottom/fin structure. Further details and advantages of such a configuration are set forth in the referenced '232 patent.

The embodiment of FIG. 1 includes a bottom gabled structure having a fin. To this end, a fourth plurality of horizontally disposed score lines divide the bottom flaps 25*d*–45*d* from the bottom fin panels 25*e*–45*e*. The score lines dividing the bottom flaps 25*d*, 35*d*, and 45*d* from the bottom fins 25*e*, 35*e*, and 45*e* lie generally along the same seventh horizontal axis 120. To facilitate formation of the gabled bottom structure, the second and fourth bottom flaps 30*d* and 40*d* each include a pair of diagonal score lines that each converge at a respective apex. Each respective apex, for example, may converge at the horizontal score lines dividing the respective bottom fin panel 30*e* and 40*e* from the bottom flap 30*d* and 40*d*. The score lines dividing the second and fourth bottom flaps 30*d* and 40*d* from the corresponding bottom fin panels 30*e* and 40*e* are angled in the illustrated manner and converge at the apex of the diagonal score lines of the corresponding bottom flap.

The vertical edges 130 and 135 of the blank 20 are generally straight and parallel to one another. These edges 130 and 135 are generally perpendicular to the edges 140 and 145 defining the upper and lower edges of the carton, respectively.

The vertical sections 25–45 are each divided from one another by a unique configuration of score lines that allows the resulting carton to bulge, thereby increasing the effective volume of the carton for a given carton surface area. In the embodiment of FIG. 1, a vertical score line 150 divides the first and second top fin panels 25*a*, 30*a* and the first and second top flaps 25*b*, 30*b*. The vertical score line 150 further extends to partially divide the first and second side panels 25*c*, 30*c* from each other. A further vertical score line 160 divides the first and second bottom flaps 25*d*, 30*d*, and the first and second bottom fin panels 25*e*, 30*e*. The further vertical score line 160 also partially divides the first and second side panels 25*c* and 30*c*. The vertical score line 150 and further vertical score line 160 are collinear along a vertical axis 165. The endpoints 170, 175 of the vertical score lines 150 and 160 are disposed a distance E from one another.

In the embodiment of FIG. 1, the endpoints 170 and 175 are joined together by a plurality of score lines that are generally displaced from the vertical axis 165. The particular configuration shown includes a score line structure in the form of an elongated hexagon. The score line structure includes a first pair of diagonal score lines 180 extending from end point 170 and a second pair of diagonal score lines 190 extending from the other end point 175. A pair of generally parallel, vertically oriented score lines 200 join the ends of the arms of the respective diagonal score lines 180 and 190, respectively.

A similar score line structure divides the second and third vertical sections 30 and 35, the third and fourth vertical sections 35 and 40, and the fourth and fifth vertical sections 40 and 45. Additionally, a vertical score line 210 bisects each of the second and fourth vertical panels 30 and 40. The vertical score lines 210, as shown in FIGS. 2A and 2B, facilitates folding the blank 20 so that it can be side sealed by the joining of the first and fifth vertical sections 25 and 45. Such sealing may be accomplished by, for example, flame sealing the joint defined by the joining of the first and fifth sections 25 and 45. Once the blank 20 has been folded and side sealed in the manner illustrated in FIG. 2B, it is ready to be packaged with other blanks for use in the magazine of a packaging machine.

FIGS. 1A, 1B, 1C, and 1D are exploded sectional views respectively of sections A, B, C, and D of FIG. 1. The exploded figures illustrate the relative orientation and position of the score lines of each of the respective labeled sections. As illustrated in FIG. 1B, the top curved score lines are offset below the remaining score lines. Similarly, as illustrated in FIG. 1C, the bottom curved score lines are offset above the remaining score line.

Figure 4:
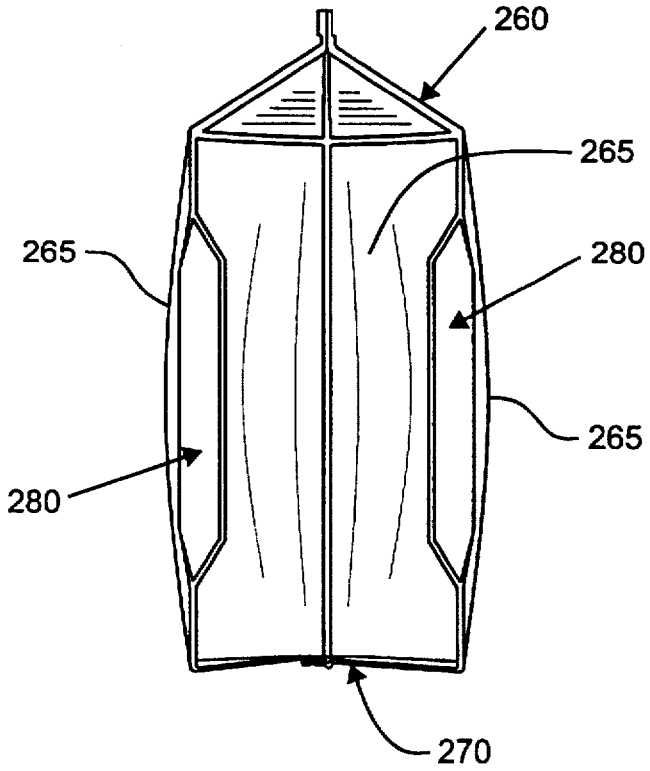

FIGS. 3 and 4 illustrate a carton formed from the blank 20. As illustrated, the carton, shown generally at 250, includes a gabled top 260 formed from the top fin panels 25*a*–45*a* and the top flaps 25*b*–45*b*, sidewalls 265 formed from the side panels 25*c*–45*c*, and a bottom structure 270 formed from the bottom flaps 25*d*–45*d* and bottom fin panels 25*e*–45*e*. The unique score line configuration dividing the sidewalls 265, shown generally at 280, are folded to form the corner sections of the carton. These corner sections allow the sidewalls 265 to bulge in the manner shown. Such bulging increases the volume capacity of the container without requiring a corresponding increase in the surface area of the carton blank 20. From another point of view, a blank may be designed for a given volume using less blank surface area and, thus, less material.

As best seen in FIG. 4, the bottom structure 270 is constructed by first forming a bottom gabled structure from the bottom flaps 25*d*–45*d* and bottom fin panels 25*e*–45*e*. The resulting bottom gabled structure is then urged into a recess that is defined by the curved score lines. Further details concerning the formation of this bottom structure can be found in the referenced '232 patent.

Figure 5:
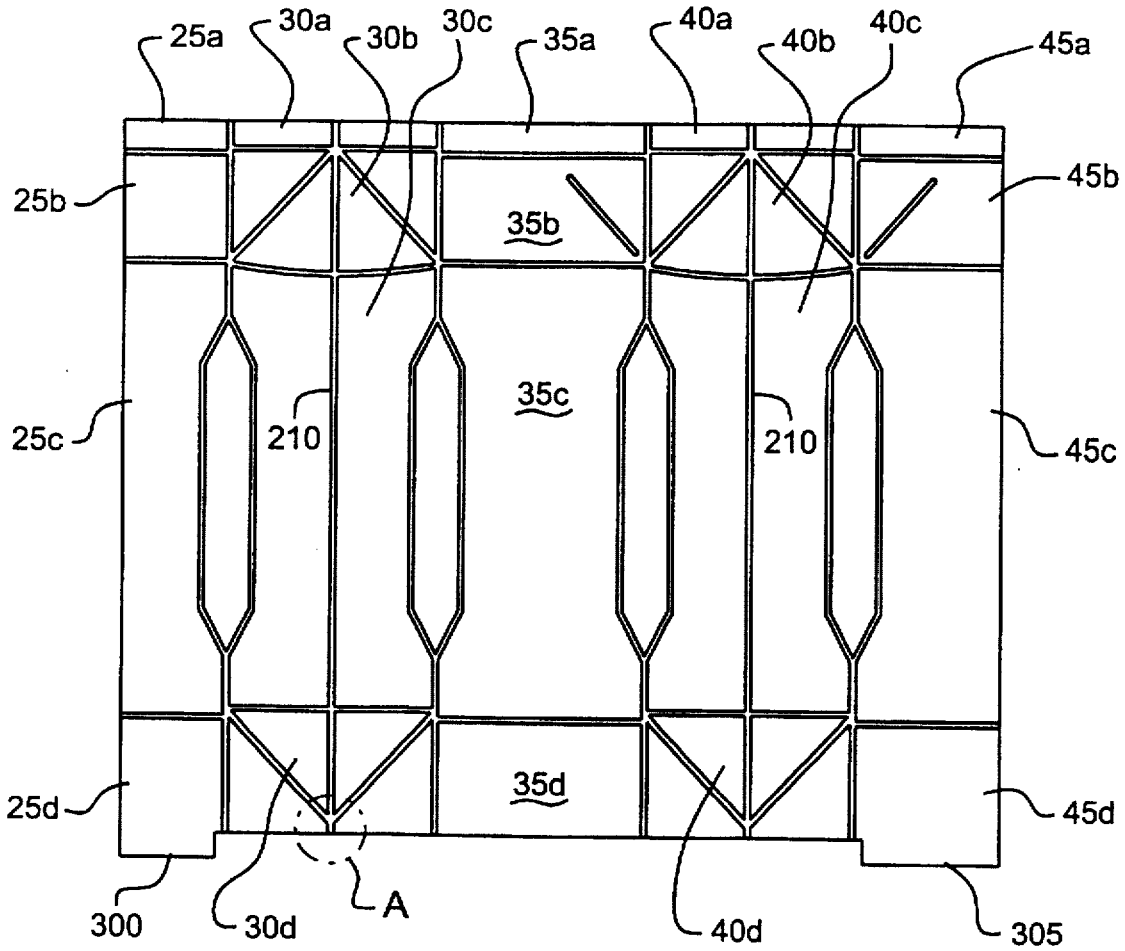
FIG. 5 is a plan view of a further embodiment of the blank of FIG. 1 having a different bottom configuration.
Figure 5:
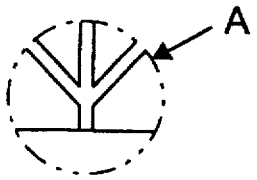

FIG. 5 illustrates a further blank 20' incorporating a bottom configuration that differs from the bottom configuration of the blank 20 of FIG. 1. No bottom fin panels are utilized in the embodiment of FIG. 5. Additionally, the score lines dividing the second side panel 30*c* and fourth side panel 40*c* from the second bottom flap 30*d* and fourth bottom flap 40*d*, respectively, are each generally straight, as opposed to curved. The first and fifth bottom flaps 25*d* and 45*d* each include an extended portion 300 and 305. The apices of the converging diagonal score lines of the second and fourth bottom flaps 30*d* and 40*d* are disposed a distance from the horizontal bottom edge of the blank 20'. The vertical line 210 that bisects the second and third vertical sections 30 and 40 extend to the bottom horizontal edge.

Figure 6:
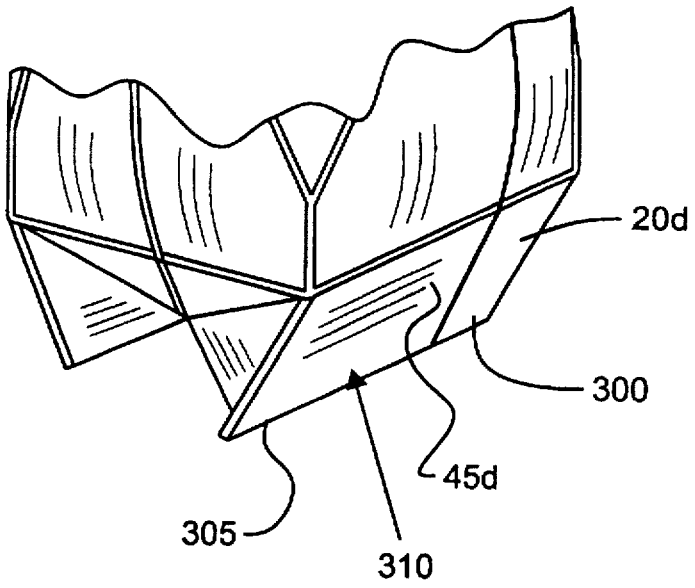
FIGS. 6 and 7 illustrate how the bottom configuration of the blank of FIG. 5 is folded.
Figure 7:
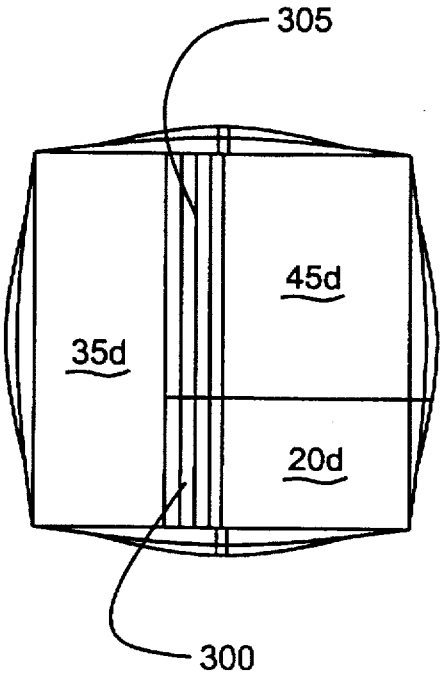

FIGS. 6 and 7 illustrate the folding of the bottom configuration of a carton formed from the blank 20'. As illustrated, the first and fifth bottom flaps 25*d*, 45*d* form an extended bottom flap, shown generally at 310, that is folded to overlie the structures formed by the remaining bottom flap sections. The overlapped portion of the extended bottom flap 310 is sealed to the opposed third bottom flap 35*d* by, for example, heat sealing the flaps together. It will be recognized that the third bottom flap 35*d* may be extended in lieu of extensions to sections 25*d* and 45*d* to overlie the first and second bottom flaps 25*d* and 45*d* when folded to form the bottom structure of the carton.

FIG. 8 illustrates the use of an extension tab 315 extending from the; third bottom fin panel 35*e*. In all other respects, the blank of FIG. 8 is the same as the blank 20 of FIG. 1. The extension tab 315 assists in providing a structurally sound seal of the bottom gabled structure. It should be noted that the extension tab may alternatively extend from both bottom fin panel 25*e* and bottom fin panel 45*e* so that they effectively form a single extension tab when the blank is side sealed. Further details concerning the extension tab may be found in the referenced '232 patent.

Figure 9:
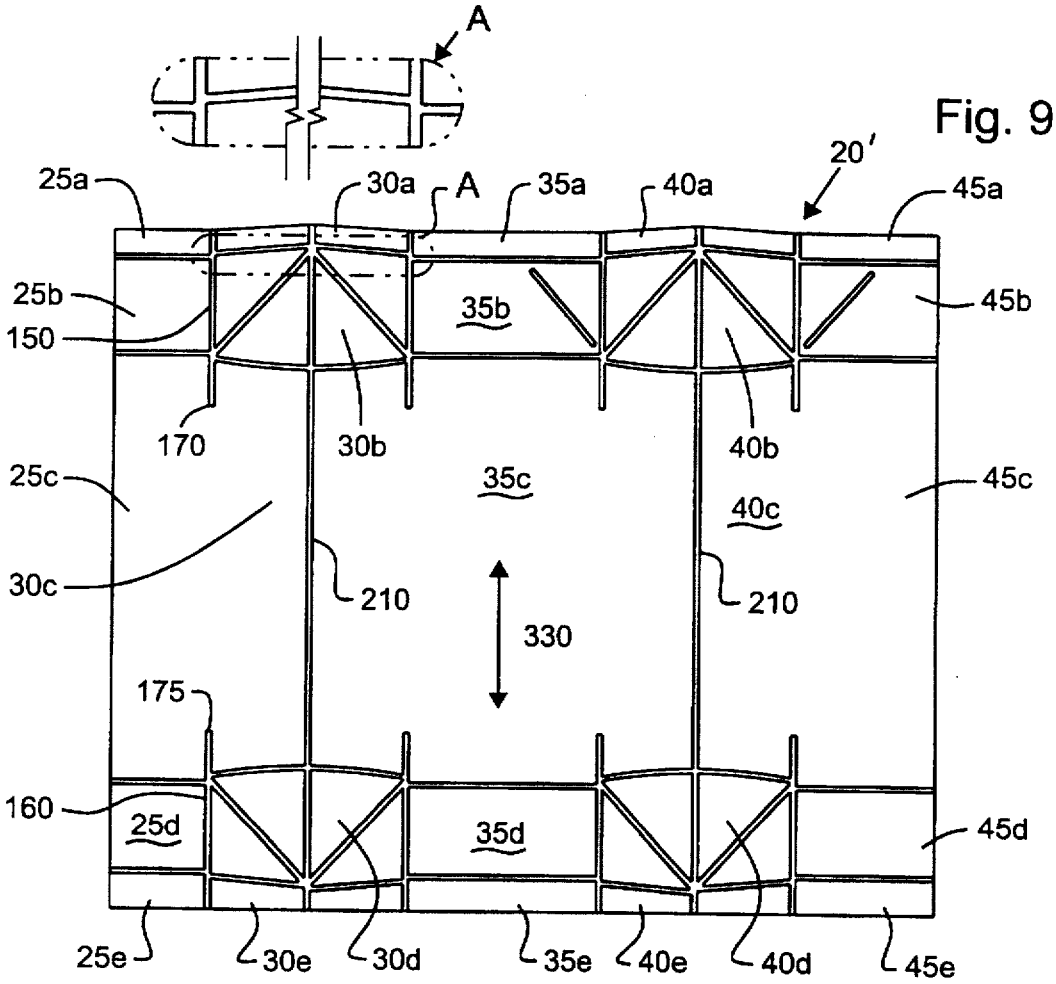
FIGS. 9, 9A, and 9B are plan views of blanks constructed in accordance with further embodiments of the invention.
Figure 9A:
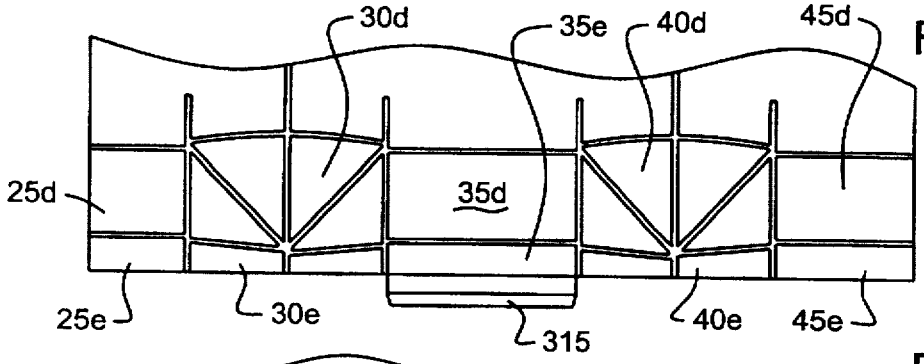
Figure 9B:
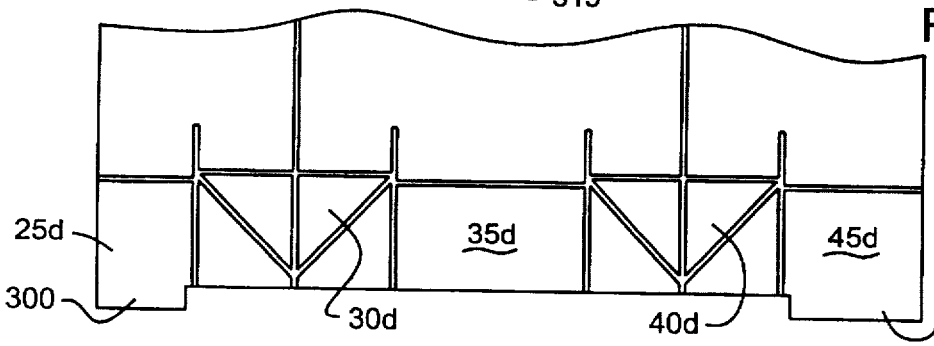

FIGS. 9, 9A, and 9B illustrate further embodiments of the present invention. In the illustrated embodiment, the blank 20' differs from the blank 20 principally in the absence of the score line configuration connecting the vertical score lines 170, 175. Blank 20' does not include any score line configuration that connects the vertical score lines 170 and 175. To compensate for the resulting loss of vertical score lines connecting score lines 170 and 175, it is preferable to form the blank 20' with the grain of the paperboard substrate in the direction of arrow 330 to assist in forming rounded corners.

Blank 20' also differs from blank 20 in that it shows an alternate top cut and top score line configuration to the top straight cut and top score line configuration of blank 20. As illustrated, the top edge of the second and fourth fin panels 30*a* and 40*a* are each cut in a diagonal manner. The score lines dividing the second and fourth fin panels 30*a* and 40*a* from the top fin flaps 30*b* and 40*b* are also angled in a manner corresponding to the angle of the diagonal cut. Exploded section A is an exploded view of the angled score lines. It will be recognized that the blank of FIG. 9 may likewise include the straight top cut and top score line configuration of the blank 20 of FIG. 1. Similarly, the blank of FIG. 1 may include the top configuration shown in FIG. 9.

FIGS. 9A and 9B show various bottom score line configurations that can be used in the blank of FIG. 9. FIG. 9A includes an extension tab as described in connection with FIG. 8 while FIG. 9B includes a bottom configuration as described in connection with FIG. 5.

Figure 10:
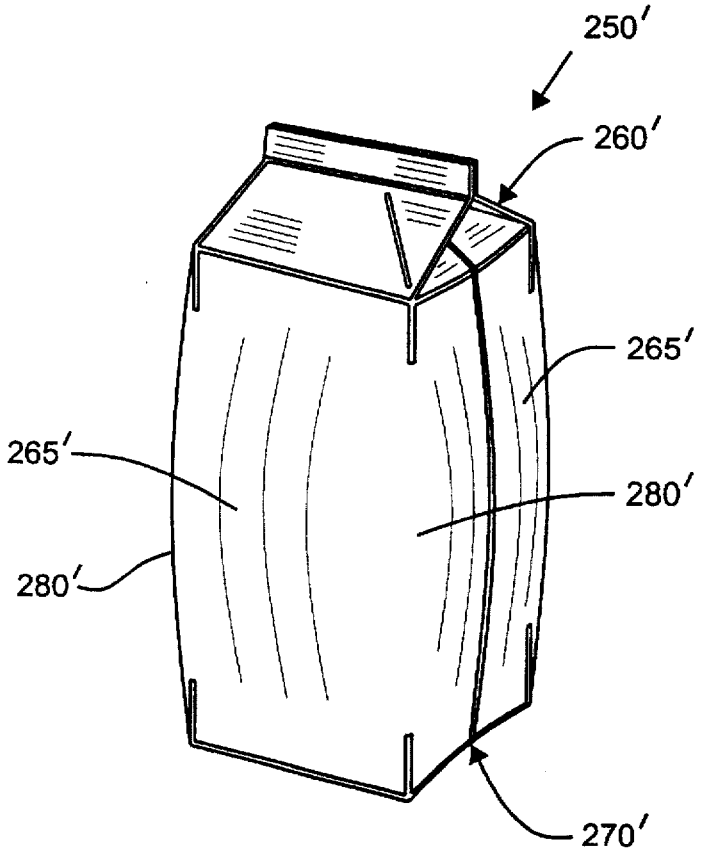
FIGS. 10 and 11 are perspective and side elevational views of a carton constructed with the blank of FIG. 9.
Figure 11:
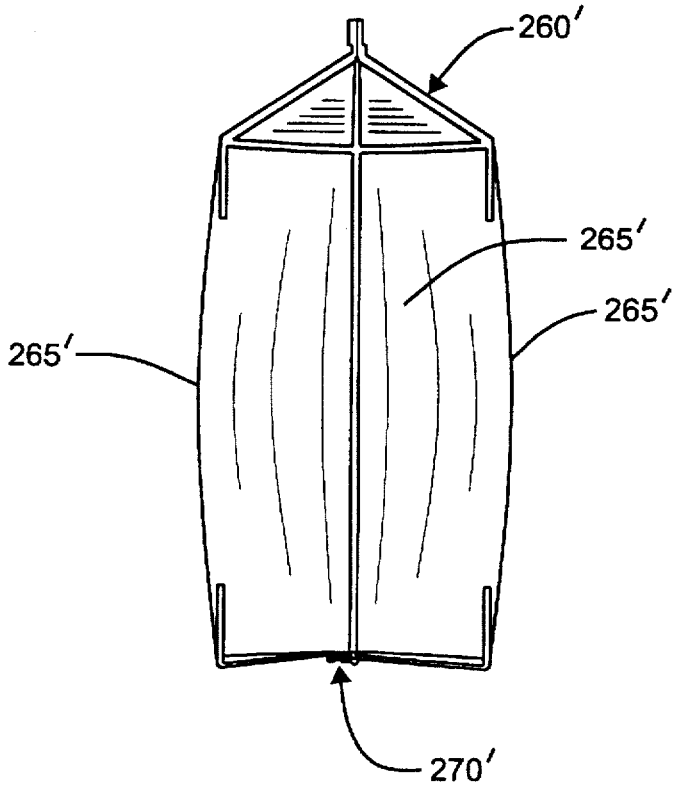

FIGS. 10 and 11 illustrate a carton 250' formed from blank 20' of FIG. 9. As shown, the corner sections 280' of the carton 250' are generally rounded and allow the sidewalls 265' of the carton to bulge in the illustrated manner. Such bulging increases the volume capacity of the carton 250' without a corresponding increase in surface area of the blank forming the carton.

Figure 12:
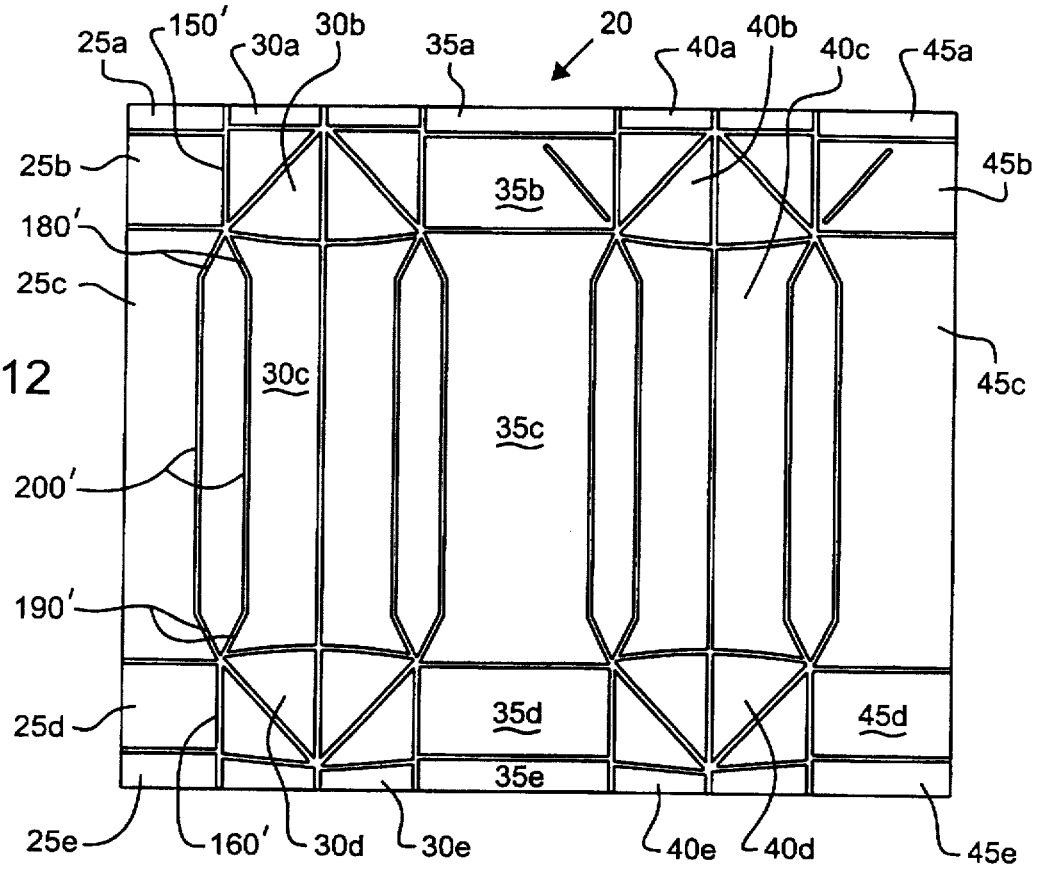
FIGS. 12, 12A, and 12B are plan views of blanks constructed in accordance with still further embodiments of the invention.
Figure 12A:
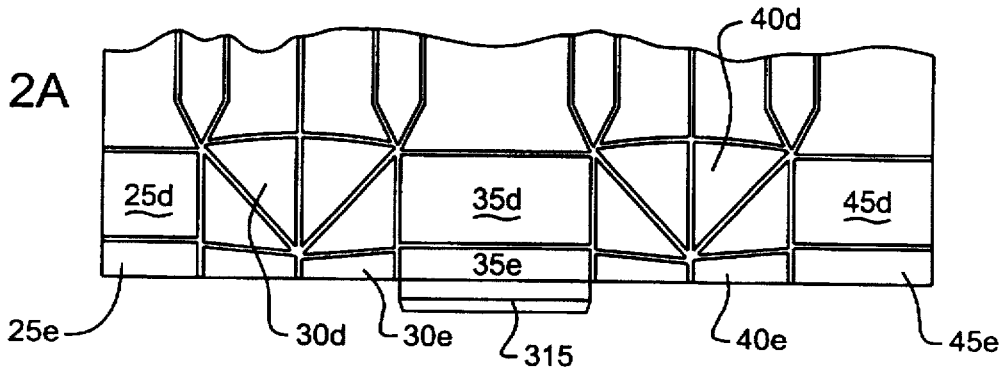
Figure 12B:
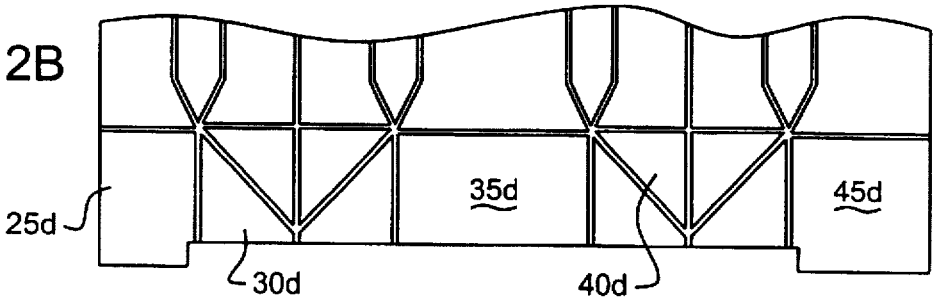

FIGS. 12, 12A, and 12B illustrate still further embodiments of the present invention. In the illustrated embodiment, the blank 20" differs from the blank 20 in that the score lines 150' and 160' partially dividing each vertical section 25–45 do not partially divide the respective side panels 25*c*–45*c*. Instead, the score lines 180', 190', and 200' forming the elongated hexagonal structures extend the full length of the side panels 25*c*–45*c*. FIGS. 12A and 12B illustrate alternative bottom configurations for the blank 20". It will be recognized that it is possible to form the bottom configuration with straight score lines in lieu of the curved score lines that are illustrated.

Figure 13:
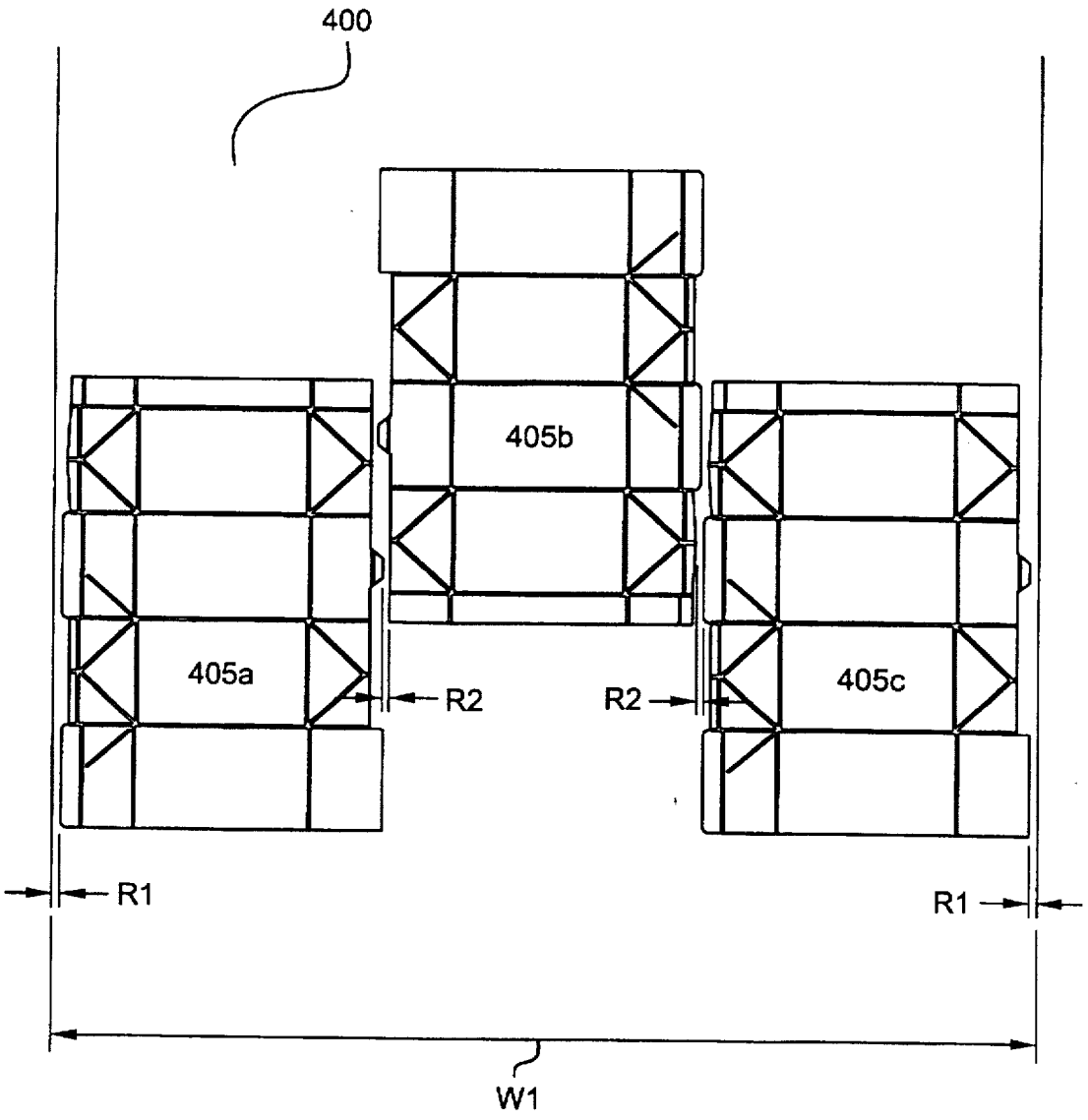
FIGS. 13–15 illustrate the material area savings obtained through practice of the present invention.
Figure 14:
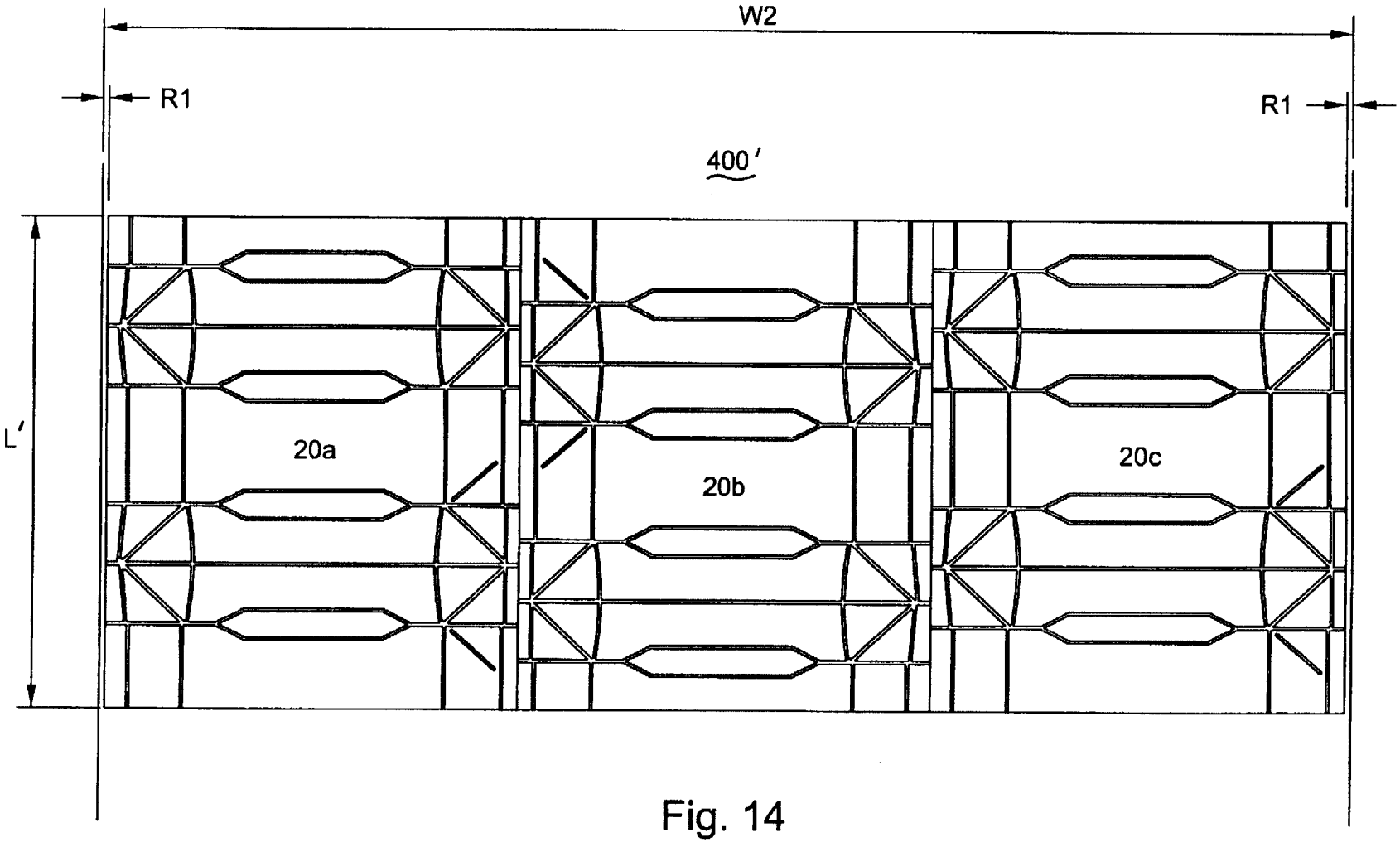
Figure 15:
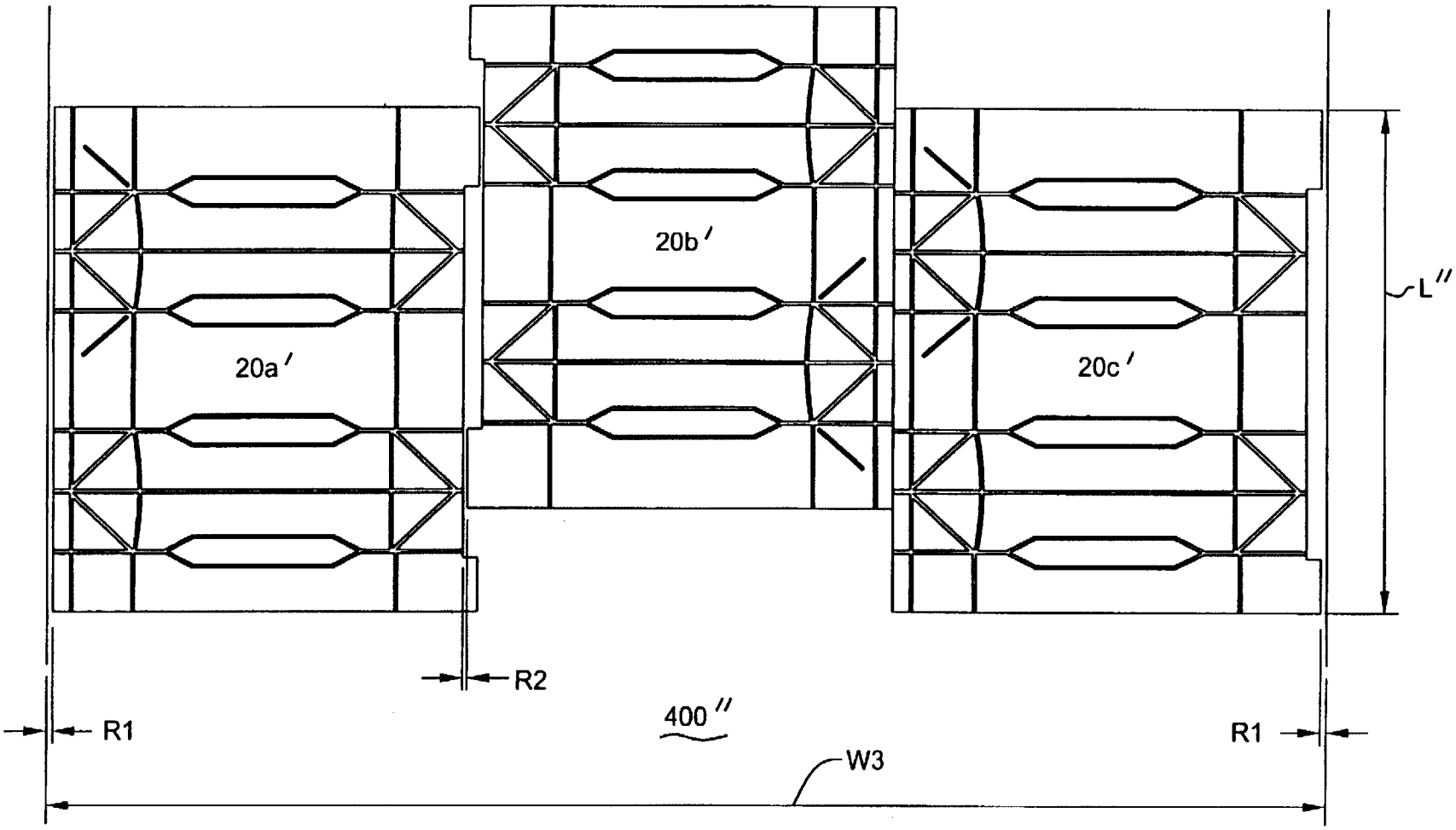

FIGS. 13–15 are plan views of a series of material roll widths from which blanks of various configurations are formed. These views are selected for comparing the average surface area of blanks of different configurations that are used to form cartons for containing the same predetermined volume of product. In FIG. 13, a standard gable top blank configuration is utilized. FIG. 14 illustrates a web having blanks of the type shown in FIG. 1 while FIG. 15 illustrates a web having blanks of the type shown in FIG. 5.

FIG. 13 shows a material web 400 from which a plurality of carton blanks 405 are formed. The carton blanks 405*a*–*c* are of a standard configuration, such as the configuration available for use on TR/6, TR/7, and TR/8 packaging machines available from Tetra Rex Packaging Systems, Inc. The web 400 has a width designated as W1. Width W1 is the minimum width required to form three carton blanks horizontally along the width. To optimize the use of the available web width, the three blanks 405*a*–*c* are arranged so that the bottom of the first carton blank 405*a* is disposed adjacent the bottom of the second carton blank 405*b* and the top of the second carton blank 405*b* is disposed adjacent the top of the third carton blank 405*c*. Additionally, the second carton blank 405*b* is offset from the first and third carton blanks 405*a* and 405*c* to further optimize the use of the web area. The carton blanks are repeated in a side-by-side manner along the length L of the web 400.

Certain portions of the web 400 are removed to form the blanks and ensure that the edges of the blanks are structurally sound. More particularly, a predetermined width of material R1 is removed from the edge portions of the web 400 to remove any damaged portions of the web thereby ensuring that the blanks adjacent the web edges are properly formed. Additionally, a continuous strip of material is removed from between blanks. This strip has a minimum width R2, which is selected to be the minimum width that may be used to remove the strip in a continuous manner without transverse tearing.

FIG. 14 shows a material web 400' from which a plurality of carton blanks 20*a–c* of the type shown in FIG. 1 are formed. The web 400' has a width designated as W2. Width W2 is the minimum width required to form three carton blanks 20*a*, 20*b*, and 20*c*. The three blanks are arranged so that the bottom of the first carton blank 20*a* is disposed adjacent the bottom of the second carton blank 20*b* and the top of the second carton blank 20*b* is disposed adjacent the top of the third carton blank 20*c*. The carton blanks are repeated in a side-by side manner along the length of the web L'.

Like the web of FIG. 13, the present web 400' has a predetermined width of material R1 that is removed from the edge portions of the web 400' to remove any damaged portions of the web thereby ensuring that the blanks adjacent the web edges are properly formed. However, since the edges of the adjacent blanks are formed as straight cuts, there is no need to remove a continuous strip of material from between them.

The required width W2 of the web 400' of FIG. 14 is greater than the width W1, but the repeat length is significantly reduced over the web of FIG. 13. This is because the dimensions of the side panels of the carton blanks can be reduced for a given container volume given the manner in which the side panels bulge due the score line configuration separating each of the side panels. Overall, for a given container volume, significantly less material is used to produce carton blanks of the type shown in FIG. 1 when compared to the conventional carton blanks illustrated in FIG. 13.

FIG. 15 shows a material web 400" from which a plurality of carton blanks 20' of the type shown in FIG. 5 are formed. The web has a width designated as W3. Width W3 is the minimum width required to form three carton blanks. To optimize the use of the available web width, the three blanks are arranged so that the top of the first carton blank 20*a'* is disposed adjacent the top of the second carton blank 20*b'* and the bottom of the second carton blank 20*b'* is disposed adjacent the top of the third carton blank 20*c'*. Additionally, the first carton blank 20*a'* is offset from the second carton blank 20*b'* to further optimize the use of the web area. The carton blanks are repeated in a side-by side manner along the length of the web L".

As was the case in connection with the arrangement of FIG. 13, certain portions of the web 400" are removed to form the blanks and ensure that the edges of the blanks are structurally sound. A predetermined width of material R1 is removed from the edge portions of the web 400" to remove any damaged portions of the web thereby ensuring that the blanks adjacent the web edges are properly formed. Additionally, a continuous strip of material is removed from between adjacent blanks. This strip has a minimum width R2, which is selected to be the minimum width that may be used to remove the strip in a continuous manner without transverse tearing.

There is a significant reduction of the overall web width W3 over the width W1 of the arrangement of FIG. 1 as well as a reduction in the repeat length. This reduction is the result, at least in part, of the reduction in side panel dimensions inherent in the use of the blank of FIG. 5.

Assuming that the blanks of FIGS. 13–15 are designed to contain one litre of product, the width W1 would be approximately 884.3 mm with a carton repeat length of about 295.2 mm. The width W2 would be approximately 893.2 mm with a carton repeat length of about 280 mm. The width W3 would be approximately 882.6 mm with a carton repeat length of about 280 mm. In each occurrence, the dimension of R1 would be approximately 3.5 mm while the dimension of R2 would be approximately 2.5 mm.

Given the foregoing, it is possible to calculate the actual surface area for each carton type. A carton blank in accordance with the standard configuration shown in FIG. 13 would have a surface area of approximately 84,427 $mm^2$. A carton blank in accordance with the configuration shown in FIG. 14 would have a surface area of approximately 82,712 $mm^2$. A carton blank in accordance with the configuration shown in FIG. 15 would have a surface area of approximately 80,649 $mm^2$.

It is desirable, however, to calculate the average web area needed for production of a single carton blank. Such a calculation provides a more realistic measure of the actual production savings in lieu of measuring the actual surface area of a single blank.

The average web area calculation involves taking the total web width and dividing it by the number of cartons across the width (three in the present instance). This value is then multiplied by the repeat length of the carton along the length of the web. Using this approach, the standard carton of FIG. 13 yields a required web area of about 87,015 $mm^2$/carton; the carton configuration shown in FIG. 15 yields a required web area of about 82,376 $mm^2$/carton; and the carton configuration shown in FIG. 14 yields a required web area of about 83,365 $mm^2$/carton. Overall, there is a material space savings approximately between 4.2% and 5.3% when the carton of the present invention is compared to a standard carton of the type shown in FIG. 13.

Although the present invention has been described with reference to a specific embodiment, those of skill in the art will recognize that changes may be made thereto without departing from the scope and spirit of the invention as set forth in the appended claims.

We claim as our invention:

1. A blank for forming a gable top carton comprising:

first, second, third, fourth, and fifth top fin panels;

first, second, third, fourth, and fifth top flaps, the second and fourth top flaps each having a pair of diagonal score lines joining at an apex;

first, second, third, fourth, and fifth side panels;

first, second, third, fourth, and fifth bottom flaps, the second and fourth bottom flaps each having a pair of diagonal score lines joining at an apex;

a first plurality of horizontally disposed score lines dividing the top fin panels from the respective top flaps;

a second plurality of horizontally disposed score lines dividing the top flaps from the respective side panels;

a third plurality of horizontally disposed score lines dividing the side panels from the respective bottom flaps;

a first vertical score line dividing the first and second top fin panels, the first and second top flaps, and partially dividing the first and second side panels;

a second vertical score line dividing the second and third top fin panels, the second and third top flaps, and partially dividing the second and third side panels;

a third vertical score line dividing the third and fourth top fin panels, the third and fourth top flaps, and partially dividing the third and fourth side panels;

a fourth vertical score line dividing the fourth and fifth top fin panels, the fourth and fifth top flaps, and partially dividing the fourth and fifth side; panels;

a fifth vertical score line dividing the first and second bottom flaps, and partially dividing the first and second side panels, endpoints of the first and fifth vertical score lines being disposed a distance from one another;

a sixth vertical score line dividing the second and third bottom flaps, and partially dividing the second and third side panels, endpoints of the second and sixth vertical score lines being disposed a distance from one another;

a seventh vertical score line dividing the third and fourth bottom flaps, and partially dividing the third and fourth side panels, endpoints of the third and seventh vertical score lines being disposed a distance from one another;

an eighth vertical score line dividing the fourth and fifth bottom flaps, and partially dividing the fourth and fifth side panels, endpoints of the fourth and eighth vertical score lines being disposed a distance from one another;

a ninth vertical score line extending along the entire length of the blank, the ninth vertical score line generally bisecting the second side panel and joining the apices of the diagonal score lines of the second top flap and the second bottom flap;

a tenth vertical score line extending along the entire length of the blank, the tenth vertical score line generally bisecting the fourth side panel and joining the apices of the diagonal score lines of the fourth top flap and the fourth bottom flap.

2. A blank as claimed in claim 1 wherein the first and fifth vertical score lines are collinear along a first vertical axis;

the second and sixth axial score lines are collinear along a second vertical axis;

the third and seventh vertical score lines are collinear along a third vertical axis; and the fourth and seventh vertical score lines are collinear along a fourth vertical axis.

3. A blank as claimed in claim 2 and further comprising:

a first plurality of score lines joining the endpoints of the first and fifth vertical score lines, the first plurality of score lines being offset from the first axis;

a second plurality of score lines joining the endpoints of the second and sixth vertical score lines, the second plurality of score lines being offset from the second axis;

a third plurality of score lines joining the endpoints of the third and seventh vertical score lines, the third plurality of score lines being offset from the third axis;

a fourth plurality of score lines joining the endpoints of the fourth and eighth vertical score lines, the fourth plurality of score lines being offset from the fourth axis.

4. A blank as claimed in claim 3 wherein each of the first, second, third, and fourth plurality of score lines comprises:

a first pair of diagonal score lines extending from one of the endpoints;

a second pair of diagonal score lines extending from the other of the endpoints;

a pair of generally parallel lines joining respective arms of the first and second pair of diagonal score lines.

5. A blank as claimed in claim 1 wherein the second plurality of horizontally disposed score lines comprises:

a first curved score line dividing the second top flap from the second side panel; and a second curved score line dividing the fourth top flap from the fourth side panel.

6. A blank as claimed in claim 5 wherein the third plurality of horizontally disposed score lines comprises:

a third curved score line dividing the second bottom flap from the second side panel; and a fourth curved score line dividing the fourth bottom flap from the fourth side panel.

7. A carton comprising:

a gabled top section;

a bottom section;

four sidewalls extending between the gabled top section and the bottom section, adjacent sidewalls of the four sidewalls being joined at corner sections, each of the corner sections being defined by a first score line extending partially down from the gabled top section and a second score line extending partially upward from the bottom section, endpoints of the first and second score lines being spaced from each other, the gabled section including an opening end and a closed end, and the sidewalls engaging the opening and closed ends engaging the opening and closed ends at curved score lines defining curved creases.

8. A carton as claimed in claim 7 and further comprising a plurality of further score lines between the first and second score lines of the corner sections, the plurality of further score lines being offset from the corner sections.

9. A carton as claimed in claim 8 wherein the plurality of score lines define an elongated hexagonal structure.

10. A carton as claimed in claim 7 wherein the sidewalls engaging the opening and closed ends each engage the bottom section at a respective curved score line defining a curved crease.

11. A carton as claimed in claim 10 wherein the bottom section is formed as a flattened gabled bottom section with a flattened fin.

12. A carton as claimed in claim 7 wherein the carton is side sealed along a single sidewall.

13. A blank for forming a gable top carton comprising:

a generally rectangular body having an upper section, a mid section, and a lower section, each of the sections being separated from each other by one or more generally horizontal score lines;

the upper section of the rectangular body comprising a plurality of score lines for defining a gabled top of the resulting carton;

the lower section of the rectangular body comprising a plurality of score lines for defining a folded bottom section of the resulting carton;

the mid section of the rectangular body comprising a plurality of score lines for defining four sidewalls of the resulting carton, adjacent sidewalls being separated from one another by a first score line partially extending from the upper section and a second score line partially extending from the lower section, endpoints of the first and second score lines being separated from one another, the second vertical section of the upper section being separated from the mid section of the second vertical section by a curved score line and the upper section of the fourth vertical section being divided from the mid section of the fourth vertical section by a curved score line.

14. A blank as claimed in claim 13 wherein the first and second score lines are generally collinear and wherein the blank further comprises a plurality of further score lines between the first and second score lines of the corner sections, the plurality of further score lines being offset from the first and second score lines.

15. A blank as claimed in claim 14 wherein the plurality of score lines define an elongated hexagonal structure.

16. A blank as claimed in claim 13 and further comprising third and fourth score lines extending along the length of the rectangular body to facilitate side sealing of the blank.

17. A blank as claimed in claim 16 wherein the blank comprises first, second, third, fourth, and fifth vertical sections, the third and fourth score lines being disposed along the second and fourth vertical sections to facilitate side sealing of the first and fifth vertical sections.

18. A blank as claimed in claim 13 wherein the blank comprises first, second, third, fourth, and fifth vertical sections.

19. A blank as claimed in claim 18 and further comprising extension panels extending from the bottom section of the first and fifth vertical sections.

* * * * *